US005465602A

United States Patent [19]

Hashimoto et al.

[11] Patent Number: 5,465,602

[45] Date of Patent: Nov. 14, 1995

[54] PRESS DIE ASSEMBLY

[75] Inventors: Kenichi Hashimoto, Ooizumi; Toshio Maehara; Yasuo Imaizumi, both of Oota; Tetsuo Asai, Azuma, all of Japan

[73] Assignee: Fuji Jukogyo Kabushiki Kaisha, Tokyo, Japan

[21] Appl. No.: 357,211

[22] Filed: Dec. 13, 1994

Related U.S. Application Data

[62] Division of Ser. No. 120,455, Sep. 14, 1993, Pat. No. 5,398,572.

[30] Foreign Application Priority Data

Sep. 18, 1992 [JP] Japan ..... 4-249208

[51] Int. Cl.[6] ..... B21D 22/00; B21D 22/20; B21D 22/22

[52] U.S. Cl. ..... 72/347; 72/463; 72/352

[58] Field of Search ..... 72/347, 348, 352, 72/463

[56] References Cited

U.S. PATENT DOCUMENTS 3,438,111 4/1969 Wilcox ..... 72/347

3,899,912 8/1975 Orain .

3,937,053 2/1976 Akamatsu ..... 72/352

*Primary Examiner*—Lowell A. Larson

*Assistant Examiner*—Rodney A. Butler

*Attorney, Agent, or Firm*—Beveridge, DeGrandi, Weilacher & Young

[57] ABSTRACT

A press die assembly is efficiently produced by: fabricating a press die pattern having therein grooves extending along concave corner portions thereof corresponding to concave corner portions of a product forming surface in the die of the press die assembly; fabricating a cast blank of the die by a full-mold method by using the press die pattern; and machining and finishing the product forming surface of the cast blank by utilizing the grooves as clearance space for the machining and finishing tools to obtain the finished die. In the press forming operation of the press die assembly, the grooves permit the sheet blank being press formed to slip thereby to eliminate local stretching, whereby high-quality pressed products are obtained. The grooves enables an easy machining by a tool.

2 Claims, 8 Drawing Sheets

PRESS DIE ASSEMBLY

This application is a divisional of application Ser. No. 08/120,455, filed Sep. 14, 1993, now U.S. Pat. No. 5,398, 572, which is incorporated entirely herein by reference.

BACKGROUND OF THE INVENTION

The present invention relates to a press die assembly and a method for producing the press die assembly particularly to a shape.

In general, a sheet metal constituting a structure such as an automobile body has surfaces of three-dimensional curvature or double curvature. In many cases, such a structure is fabricated by press forming.

In the press forming of such panel structures, the press die is an important part. The press die usually comprises a punch and a die. A panel as a workpiece is laid on the press die and formed by the punch.

As will be described in detail hereinafter, a recessed surface portion of the press die often has a concave corner portion extending linearly or with a curvature. On the other hand, the punch has a convex corner portion matched to the concave corner portion of the press die. Conversely, the recessed surface portion of the press die has a convex corner portion while the punch has a concave corner portion.

In either case, the concave and convex corner portions tend to interfere with each other unless they are precisely machined so as to avoid any interfering engagement therebetween when the punch plunges into the recessed surface portion of the die. However, precise machining of the concave and convex corner portions requires machining tools of different sizes for different machining processes from a rough machining to a finished machining. Precise machining further requires a numerically controlled three-dimensional machining under various machining conditions such as different cutting speeds for different tools. This is inefficient and time consuming.

SUMMARY OF THE INVENTION

An object of the present invention is to provide a method of producing a press die assembly which eliminates the problems described above and which does not require precise finish machining of the concave and convex corner parts of the press die and/or the punch.

Another object of the present invention is to provide a method of producing a press die assembly in which machining steps are significantly reduced and in which trial and adjustment of the press die assembly are simplified because interference between the concave and convex corner parts can be readily avoided.

A further object of the present invention is to provide a press die assembly in which a panel blank is formed in a state wherein it is permitted to slip between confronting convex and concave corner parts whereby high tension at a specific position of the panel is reduced and a pressed product of high quality is obtained with uniform thickness and without defects such as cracks, constrictions or furrowing.

According to the present invention, in one aspect thereof, there is provided a method for producing a press die assembly Comprising the steps of fabricating a press element pattern having a concave corner portion on a surface thereof, preparing a casting mold formed on the basis of the press element pattern, pouring a metal into the casting mold to cast a blank of a press element having a concave corner portion corresponding to said concave corner portion of the press element pattern, and machining the blank to form a product forming surface with a concave corner portion, an improvement of the method comprising the steps of forming a first groove along the concave corner portion of the press element pattern prior to the step of preparing the casting mold, pouring the metal to cast a blank of the press element with a concave corner portion having a second groove therealong corresponding to the first groove, and machining the blank to form the product forming surface by utilizing the second groove as clearance space of the tool.

According to the present invention, in another aspect thereof, there is provided a press die assembly having a press element with a product forming surface having a concave corner portion, an improvement of the press element comprising a groove formed along the concave corner portion, the groove functioning as a clearance space for a machining tool and allowing a workpiece being pressed to slip during press forming.

A preferred embodiment of the present invention will be understood from the following detailed description referring to the accompanying drawings.

DESCRIPTION OF THE PREFERRED EMBODIMENT

As conducive to a full understanding of the present invention, the general nature, limitations, and attendant problems of the prior art will first be considered with reference to one example of a known method as illustrated in FIGS. 10 through 15.

Figure 10:
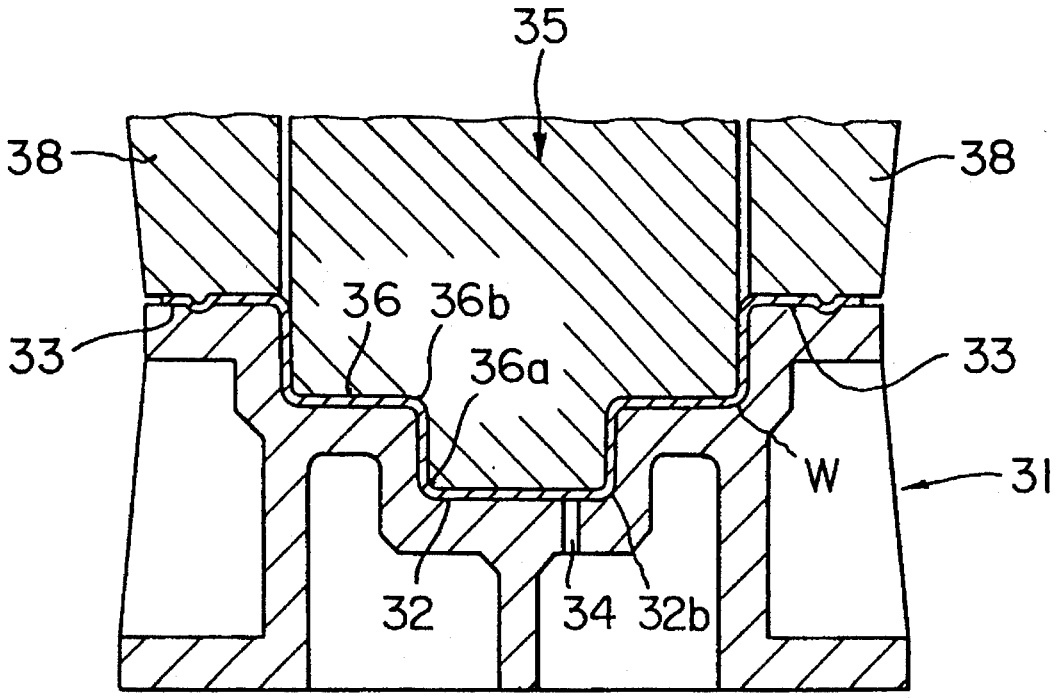
FIG. 10 PRIOR ART
FIG. 10 is a partial vertical section showing a press die assembly of the prior art.

Referring to FIG. 10, a die 31 constitutes an essential part of a press die assembly and has a concave or recessed surface portion 32 and a stationary clamping surface 33 formed contiguously and around the outer periphery of the recessed surface portion 32. The bottom of the recessed surface portion 32 is communicatively connected to the inner end of an air vent hole 34 formed through the die 31. The vent hole 34 serves to allow air caught between a panel (sheet metal, workpiece) w, and the recessed surface portion 32 to escape to the outside.

Above the die 31, a punch 35 is provided which is capable of up-and-down movement in confrontal relation to the die 31. The punch 35 has a lowermost ram surface 36 which fits into the recessed surface portion 32 over the panel w interposed therebetween. Around the punch 35 is disposed a blank holder 38 which can move up and down freely and independently of the punch 35. When a blank is to be press formed into a panel w, it is laid on the clamping surface 33. The blank holder 38 is then lowered so that the lower surface thereof holds the outer peripheral part of the blank firmly against the clamping surface 33 of the die 31.

Figure 11:
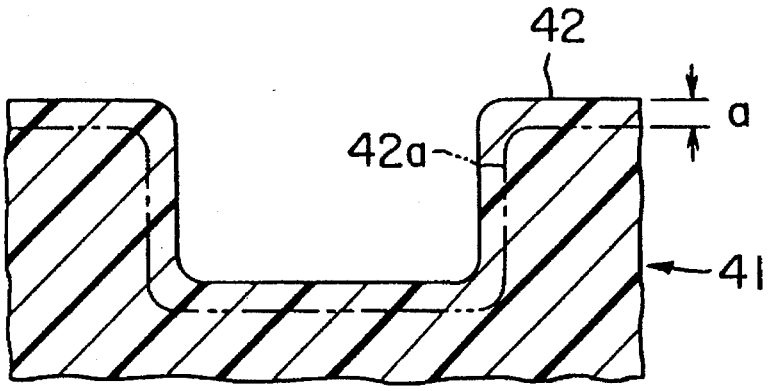
FIG. 11 PRIOR ART
FIG. 11 is an enlarged fragmentary view, in vertical section, of a press die pattern used for the production of the prior art press die assembly.

A constituent part, such as the die 31, of a press die assembly of the character described above is fabricated in the following manner. First, in accordance with a design drawing of the die 31, a press die pattern 41 as shown fragmentarily in FIG. 11 is made by three-dimensional machining a foamed polystyrol (polystyrene) block by an end mill or a nichrome-wire cutter. The press die pattern 41 is fabricated to dimensions which are larger by a finish allowance a than the finished dimensions to which the die 31 is to be fabricated. In FIG. 11, the solid line 42 indicates the dimensions to which the die pattern 41 is made, while the single-dot chain line 42a indicates the dimensions of the finished die 31. The finish allowance a is provided to allow for material removal due to milling and polishing to be carried out later.

Figure 12:
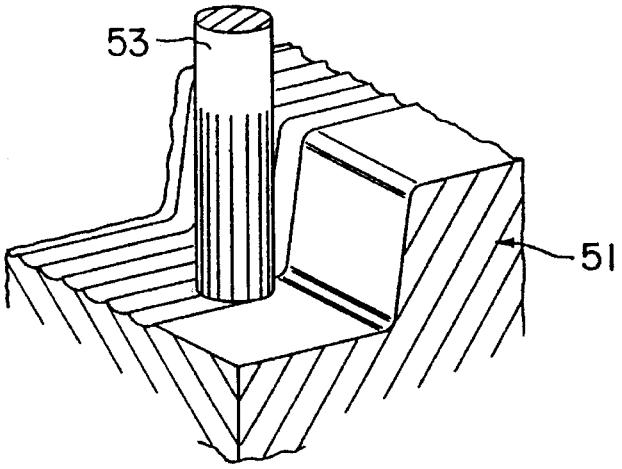
FIG. 12 PRIOR ART
FIG. 12 is a fragmentary perspective view of a cast blank in a machining step of producing a press die assembly of the prior art.

As shown in FIG. 12, a cast blank 51, which is to become the die 31, is formed by a known full-mold method. More specifically, the full-mold method comprises imbedding the die pattern 41 in molding sand in a molding box and pouring molten die metal onto the die pattern 41 thereby to Cause it to disintegrate and vanish, the die metal filling the space vacated by the die pattern 41. Thus a casting (i.e., the cast blank 51) of the same configuration as the die pattern 41 is obtained.

Rough machining of the cast blank 51 formed in this manner is carried out by numerically controlled three-dimensional machining with a large-diameter machining tool such as an end mill 53 as shown in FIG. 12. Next, finish machining of the rough machined cast blank 51 is carried out by numerically controlled three-dimensional machining with a slightly smaller diameter end mill.

Figure 13:
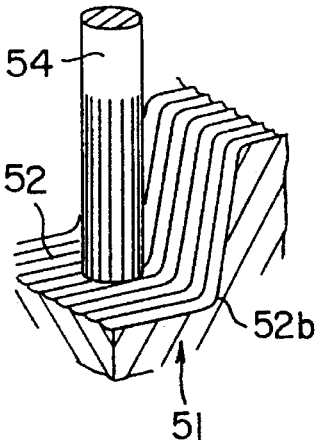
FIG. 13 PRIOR ART
FIGS. 13, 14 and 15 are three fragmentary perspective views respectively illustrating succeeding steps in the machining of the cast blank to produce the press die assembly according to the prior art.
Figure 14:
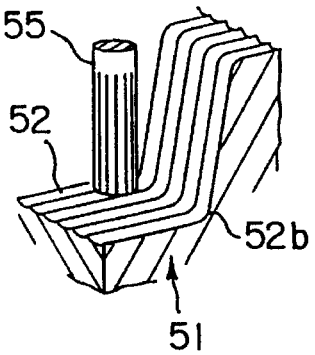
FIG. 14 PRIOR ART
Figure 15:
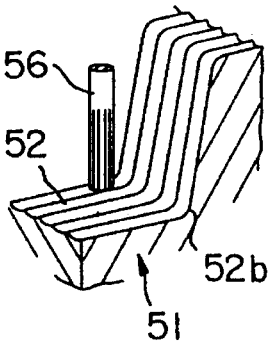
FIG. 15 PRIOR ART

The cast blank 51 which has undergone the finish machining undergoes succeeding steps of finish machining of specific precise portions. In the steps, particularly the concave corner portions 52*b* corresponding to the concave corner portions 32*b* of the die 31 are machined three-dimensionally under numerical control, as shown in FIG. 13, with an end mill 54 of a diameter equivalent to, or slightly smaller than the minimum radius of curvature of the press die assembly. The machining is then carried out further with end mills 55 (FIG. 14) and 56 (FIG. 15) of successively smaller diameters.

Next, a concave surface portion 52 to become a surface for clearance adjusting and product forming of the cast blank 51 is subjected to polish finishing. A communication hole is then drilled through an appropriate part of the cast blank 51 thus finished, and a vent tube is inserted through the communication hole thereby to provide a vent hole for allowing air to flow out. Thus a die 31 is obtained.

The die 31 is assembled with the punch 35 and other constituent parts fabricated by similar processes whereupon the objective die assembly is assembled.

The press assembly thus assembled is mounted in a press machine and is tried and adjusted. Thus the production of the die assembly is completed.

Japanese Patent Publication No. 59-39264 discloses a prior art method of producing a press die assembly in which a large-diameter tool is used for rough machining in order to increase the machining efficiency and a small-diameter tool is used in the succeeding step.

As will be noted from the foregoing description, the known method of producing a press die assembly requires machining tools of many different sizes used for different machining steps including a rough machining and a finish machining and further requires a numerically controlled three-dimensional machining under various machining conditions such as different cutting speeds suitable for different tools. Furthermore, when a small-sized cutting tool is used for finish machining of specific precise portions, the cutting speed must be decreased to avoid tool damage. This is inefficient. Moreover, a high degree of skill is needed for finish machining die assembly portions such as convex and concave corner portions.

The present invention, which has succeeded in overcoming the problems described above, will now be described with respect to an embodiment thereof as illustrated in FIGS. 1 through 9.

Figure 1:
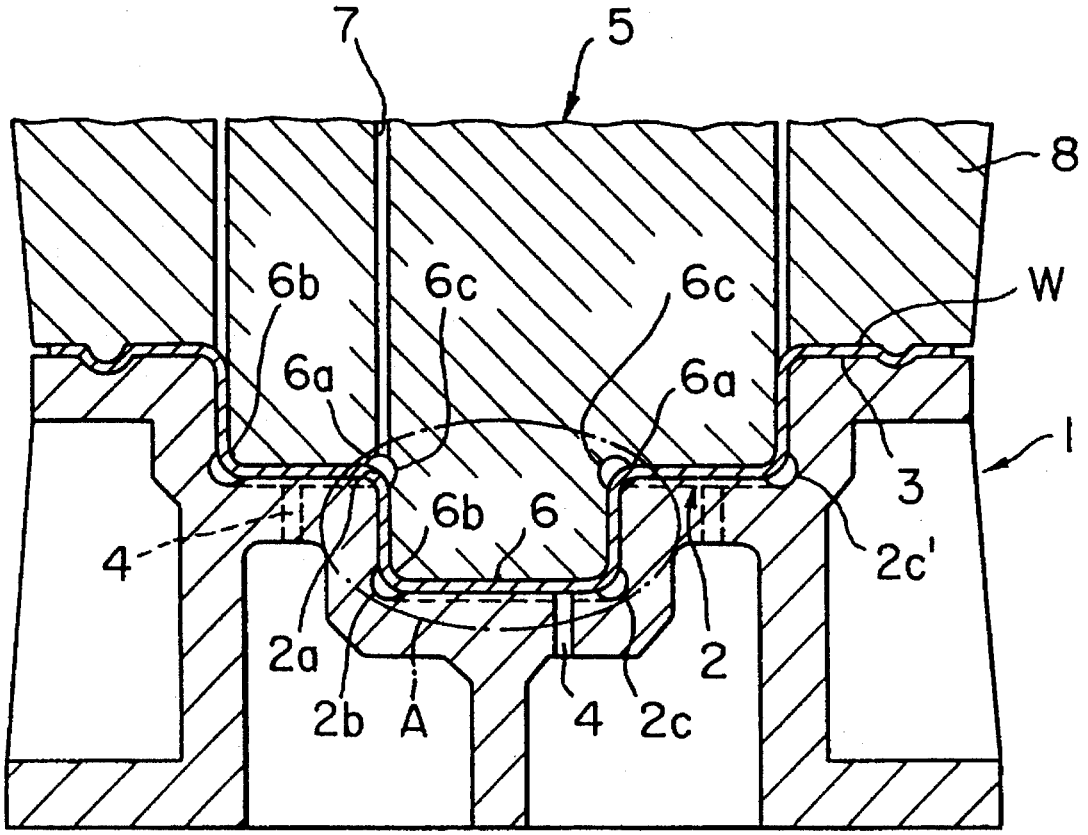
FIG. 1 is a partial vertical sectional view showing a press die assembly according to the present invention.
Figure 2:
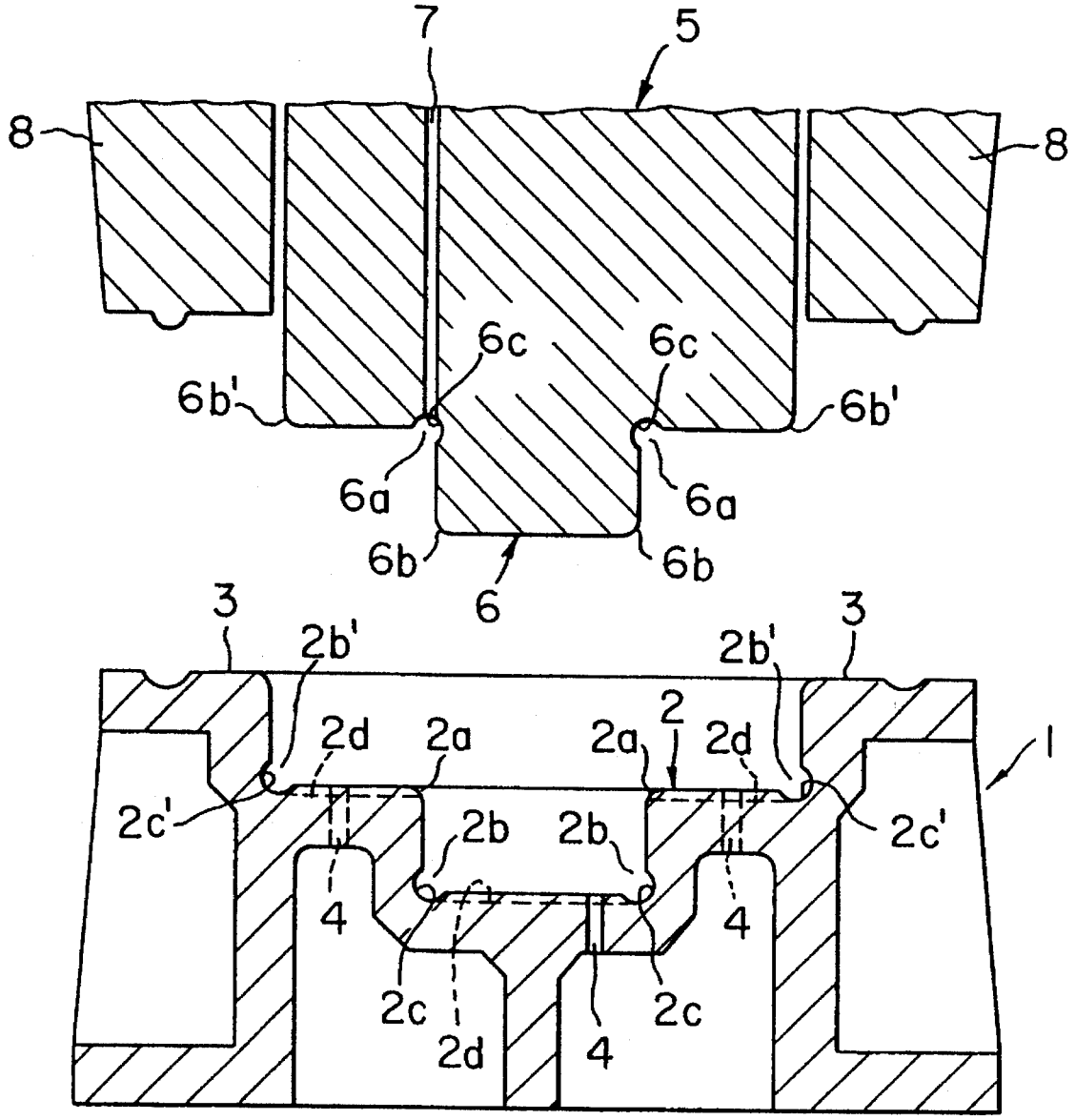
FIG. 2 is a vertical sectional view of the press die assembly in a state wherein a punch and a blank holder are raised above a press die.
Figure 3:
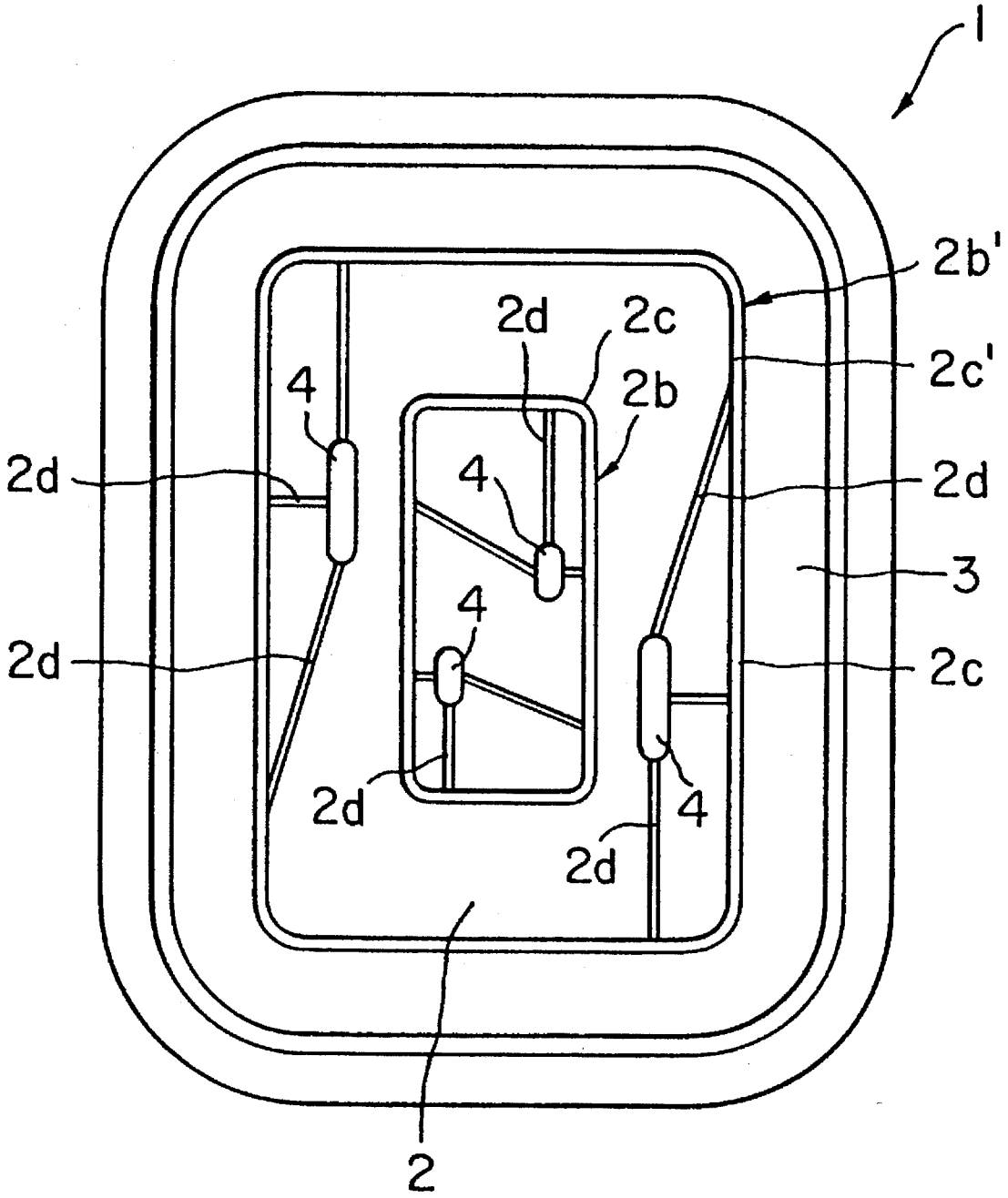
FIG. 3 is a schematic plan view of the press die in the assembly shown in FIG. 1.

FIG. 1 is a vertical sectional view of a press die assembly according to the present invention. As will be clearly understood from FIG. 2 showing a state prior to the operation of the press die assembly, the assembly includes a die 1 having a concave or recessed surface portion 2 to function as a product forming surface, and a stationary clamping surface 3 formed contiguously to and around the outer periphery of the recessed surface portion 2. The recessed surface portion 2 has a convex corner portion 2*a* and concave corner portions 2*b* and 2*b*'. As indicated in FIG. 3 showing a plan view of the die 1, each of the convex and concave corner portions 2*a*, 2*b* and 2*b*' may have a closed shape. The closed shape may be a rectangular shape with rounded corners as shown or an annular shape. Alternatively, the shape of each corner parts may be an open shape having a linearly extending portion and/or a curved portion. Grooves 2*c* and 2*c*' are formed along the concave corner portions 2*b* and 2*b*', respectively.

As indicated in FIG. 3, the grooves 2*c* and 2*c*' are communicatively connected by way of several third small grooves 2*d* cut in the recessed surface portion 2 to the inner ends of vent holes 4 formed through the die 1. The grooves 2*c* and 2*c*' thus permit air entrapped between a panel (workpiece) w (FIG. 1) and the recessed surface portion 2 of the die 1 to escape to the outside.

As indicated in FIGS. 1 and 2, a punch 5 is provided above the die 1 which punch 5 is capable of up-and-down movement in confrontal relation to the die 1. The punch 5 has at a lower end thereof a ram surface 6. The lower end of the punch 5 is shaped to be complemental to the recess surface portion 2. As the punch 5 descends and fits into the recessed surface portion 2 of the die 1 over a panel blank w interposed therebetween, the ram surface 6 functions as a product forming surface for press forming the panel blank w. Around the outer periphery of the punch 5, a blank holder 8 is disposed to move up and down independently of the punch 5. After a panel blank w has been laid on top of the stationary clamping surface 3 of the die 1, the blank holder 8 is lowered to thereby firmly clamp and hold the blank w.

The punch 5 has a concave corner portion 6*a*, along which a groove 6*c* is formed. The groove 6*c* functions to permit air interposed between the panel blank w and the punch 5 to escape via a vent hole 7 formed through the punch 5 to the outside.

The method according to the present invention for producing a press die assembly described above will now be described with respect to one example as outlined in the process chart shown in FIG. 4.

The die 1 constituting an essential part of the press die assembly is fabricated in the following manner. In accordance with the design drawing of the die 1, a press die pattern 11 as shown in FIG. 5 is made from a foamed polystyrol (polystyrene) block by three-dimensional surface machining by an end mill or a nichrome-wire cutter (Step 1 in FIG. 4). FIG. 5 is an enlarged sectional view corresponding to the enclosed part A in FIG. 1. In FIG. 5, the solid line 12 indicates surface dimensions and profile to which the recessed surface portion of the die pattern 11 is made. The single-dot chain line 12*a* indicates surface dimensions and profile of the recessed surface 2 of the finished die 1. Thus, the die pattern 11 is made to dimensions which are larger by a finishing allowance a than the finished dimensions to which the die is to be milled and polished in Steps 4, 5, and 6 as described hereinafter. The die pattern 11 is also provided with through holes 14 corresponding to the vent holes 4 of the die 1.

Figure 6:
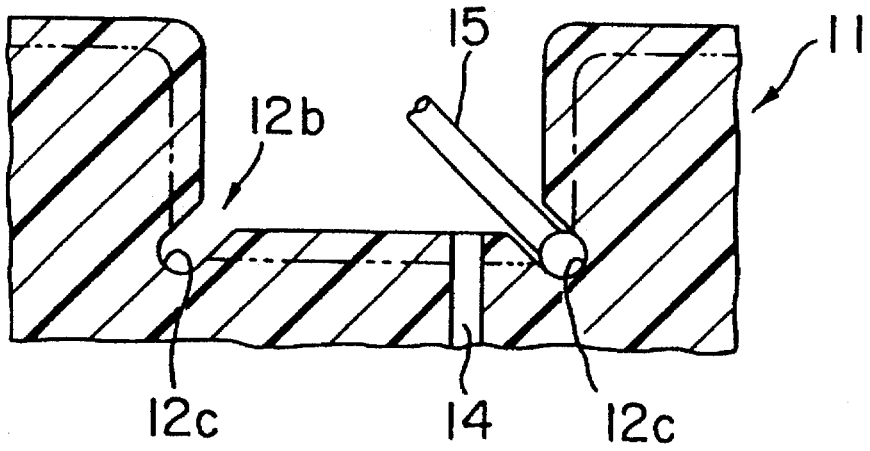
FIG. 6 is an enlarged fragmentary view, in vertical section, of the press die pattern and shows a step in the process of making the same.
Figure 7:
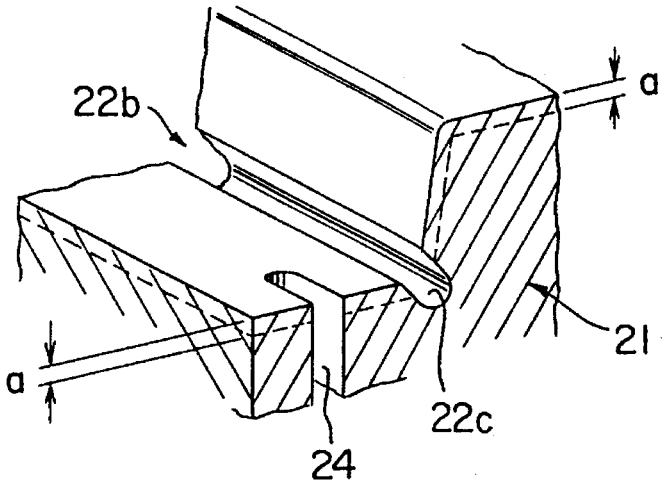
FIG. 7 is a fragmentary perspective view of a cast blank for a description of the machining thereof to produce the press die.

Next, as indicated in FIG. 6, a groove 12*c* is formed by milling (Step 2 in FIG. 4), by means of a machining tool 15 such as a ball end mill, in the die pattern 11 along the concave corner portion 12*b* thereof corresponding to the concave corner portion 2*b* of the die 1 to be fabricated. The groove 12*c* is thus milled to dimensions such as to form the groove 2*c* of the die 1. The groove 12*c* is also to serve as a clearance for the machining tool such as an end mill for the Steps 4, 5, and 6 described hereinafter. The forming by milling of the groove 12*c* is readily accomplished because the die pattern material is foamed polystyrol.

Figure 4:
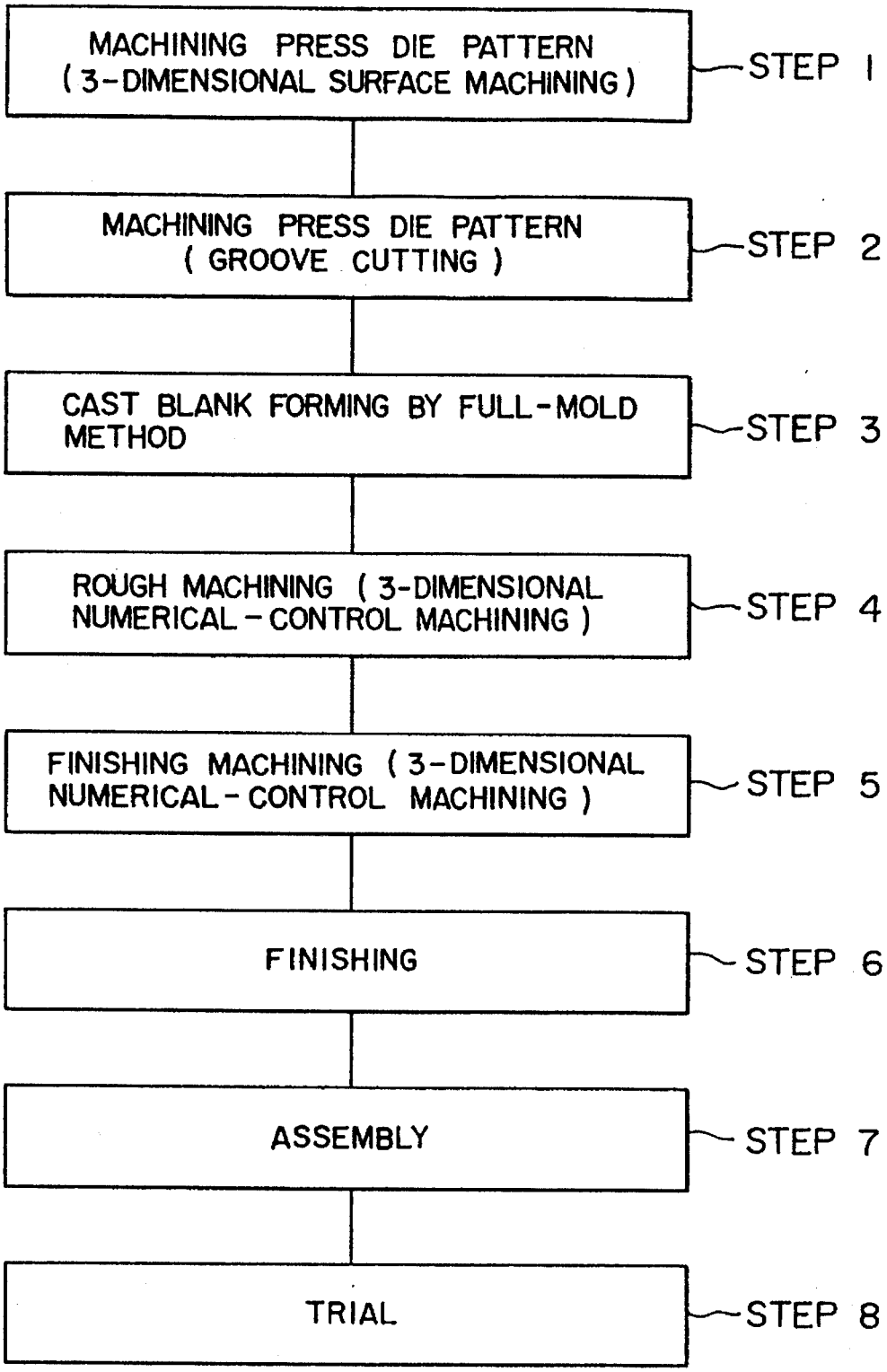
FIG. 4 is a flow chart indicating an example of producing a press die assembly according to the present invention.
Figure 5:
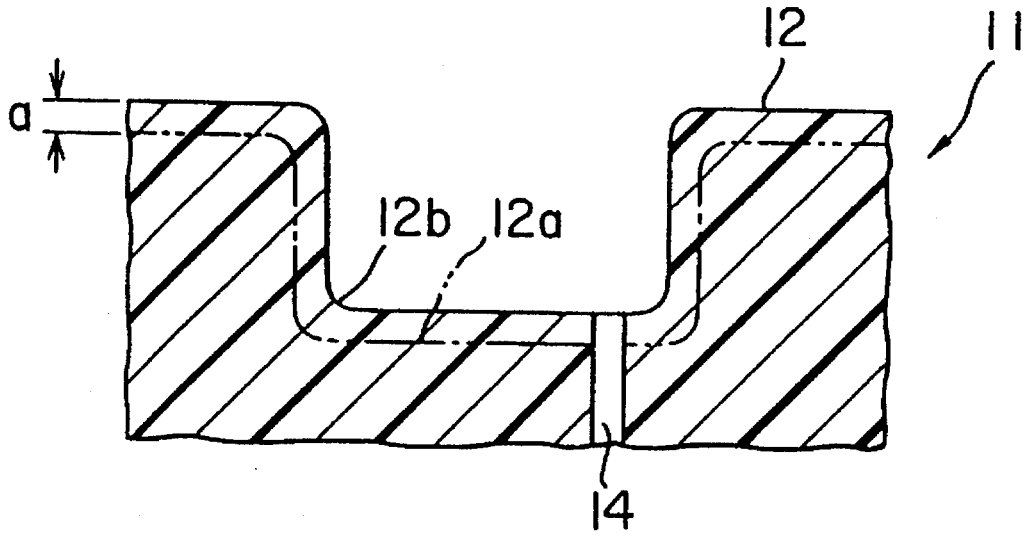
FIG. 5 is an enlarged fragmentary view, in vertical section, of a press die pattern used for the production of the press die.

Next a cast blank 21 (FIG. 7) to be machined into the die 1 is formed by a full-mold method (Step 3 in FIG. 4). By this method the die pattern 11 made of the polystyrol material in Step 2 is first imbedded in molding sand in a molding box. Then molten die metal is poured onto the die pattern 11 thereby to cause it to disintegrate and vanish by heating. The die metal thereby fills the space vacated by the die pattern 11. Thus a casting of the same configuration as the lost die pattern 11 is obtained. This casting is the cast blank 21. The cast blank 21 has the machining and finishing allowance a described hereinabove. The machining and finishing allowance a is provided for the purpose of machining and finishing the blank 21 while leaving through holes 24 to become the vent holes 4 of the die 1, grooves 22*c* to become the grooves 2*c* of the die 1 along concave corner portions 22*b* corresponding to the concave corner portions 2*b* of the die 1, and the bottom portions of the grooves 22*c*.

Figure 8:
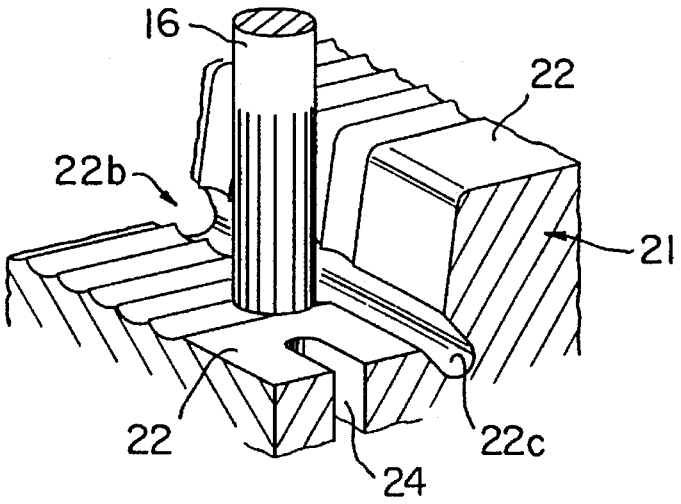
FIG. 8 is a view indicating a rough machining step.

The cast blank 21 formed by casting in Step 3 next subjected to rough machining (Step 4 in FIG. 4: three-dimensional numerically controlled machining). In the Step 4, portion 22 to become the concave surface portion 2 of the die 1 is thus rough machined by a machine tool in accordance with preset control information. The machining uses a large-diameter machining tool such as an end mill 16 as shown in FIG. 8. In the Step 4, the three-dimensional, numerically controlled machining can be easily carried out since the grooves 22*c* formed previously in the concave corner portions 22*b* in the cast blank 21 in Step 3 were formed to serve as a clearance space for the end mill 16. Moreover the rough machining can be carried out efficiently because the concave corner portions 22*b* are not machined.

Figure 9:
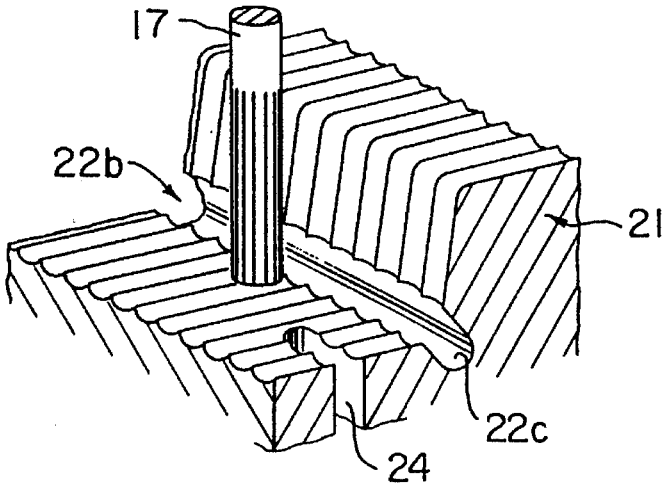
FIG. 9 is a view indicating a finish machining step.

Next the cast blank 21 which has undergone rough machining in Step 4 is subjected to finish machining in Step 5 (three-dimensional, numerically controlled machining) by using an end mill 17, as shown in FIG. 9, of a diameter smaller than that of the end mill 16 used in Step 4. The finish machining is carried out with the grooves 22*c* serving as a clearance space for the machining tool while leaving the bottom parts of the grooves 22*c*. This operation is carried out responsive to preset control information similarly as in Step 4.

In the succeeding Step 6, the concave surface portion 22 of the cast blank 21 is subjected to finishing by polishing to a smooth surface. In addition, small grooves are incised in the concave surface part 22 by using a tape for numerical control to thereby communicatively connect the grooves 22*c* and the through holes 24 to become the vent holes 4. Thus the die 1 is obtained.

As the grooves 22*c* to become the grooves 2*c* (2*c*') have been formed, there is no possibility of the concave corner portion 2*b* (2*b*') abutting against the convex corner portion 6*b* (6*b*') of the punch 5 during operation of the press die assembly. It will be understood that this procedure eliminates the operation of machining the concave corner portions, which has been carried out in the prior art and which requires a high degree of precision and a high degree of skill. Thus a significant reduction in man-hours of labor becomes possible.

Then, together with the punch 5 fabricated by a similar process and other constituent parts, the thus finished die 1 is assembled into the press die assembly (Step 7).

The press die assembly thus assembled is mounted in a press machine (not shown) and put through a trial operation. During this operation, adjustments as necessary are carried out. Thus the production of the press die assembly is completed.

While grooves were formed to provide clearance for the tool used in machining the concave corner portions of the die 1 and the punch 5 in the above described embodiment, the grooves may be formed in either one of the die 1 and the punch 5. Furthermore, grooves can be formed along only concave corner portions requiring such grooves.

In a press die assembly produced by the method described above, a groove is formed at an appropriate position. For this reason, during an operation of press forming a panel blank in the press die assembly of the present invention, the panel blank is formed in a state wherein it is permitted to slip between confronting convex corner portions and concave corner portions. Thus local high tension at specific parts of the panel is reduced, and this results in obtaining pressed products of high quality in which the sheet thicknesses are uniform without defects such as cracks and constrictions or furrowing.

According to the method for producing a press die assembly of the present invention, it is not required to machine the convex and concave corner portions of the press die and/or the punch. This is made possible by simply forming a groove along the concave corner portion. The groove permits a machining tool to partially enter the same for easy cutting of the concave corner portion to precise dimensions. Furthermore, the method of the present invention makes it possible to remarkably reduce the number of the machining steps and to simplify the trial and adjustment of the press die assembly because the groove formed serves to avoid interference between the concave and convex corner portions.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A press die assembly for transforming a sheet material into a desired shape of a product by press working thereof comprising a punch and a die, a side wall portion provided in said die to form a recessed surface portion for slidably receiving said punch via said sheet material and for entirely surrounding a periphery of said punch;

a bottom surface provided at said recessed surface portion of said die and connected to a lower end of said side wall portion for receiving a lower end portion of said punch via said sheet material; and a corner portion interposed between said side wall portion and said bottom surface and provided with a groove whereby clearance space is provided for a cutting tool while finish machining each of said side wall portion and said bottom surface so as to easily and accurately operate said tool and to avoid interference with the punch at the corner portion.

2. The press die assembly according to claim 1, wherein:

said bottom surface has a communication groove connected to said groove; and said die has a vent hole communicating with said communication groove for escaping air trapped on said bottom surface and in said groove so as to easily slip said sheet material without interfering with convex corner portions during said press working and to obtain a high quality of said product.

* * * * *